US005192131A

United States Patent [19]

Hatfield

[11] Patent Number: 5,192,131

[45] Date of Patent: Mar. 9, 1993

[54] STIRRING DEVICE

[76] Inventor: Charlotte A. Hatfield, 3505 Porter St., Texarkana, Ark. 75502

[21] Appl. No.: 910,582

[22] Filed: Jul. 8, 1992

[51] Int. Cl.[5] ..... B01F 7/16

[52] U.S. Cl. ..... 366/308; 366/343

[58] Field of Search ..... 366/308, 279, 285, 286, 366/244, 247, 342, 343

[56] References Cited

U.S. PATENT DOCUMENTS

| | | | |
|---|---|---|---|
| 3,559,962 | 2/1971 | Enssle | 366/308 |
| 4,355,906 | 10/1982 | Ono | 366/308 |
| 4,872,764 | 10/1989 | McClean | 366/308 |

*Primary Examiner*—Robert W. Jenkins

*Attorney, Agent, or Firm*—Leon Gilden

[57] ABSTRACT

An elongate inner tubular sleeve is slidably mounted within an outer tubular sleeve, with the inner sleeve mounting a plurality of actuator links to permit axial displacement of the inner sleeve relative to the outer sleeve, wherein the inner sleeve pivotally mounts an annular array of paddle blades at a lower distal end of the inner sleeve that are positioned exteriorly of the outer sleeve, whereupon axial displacement of the inner sleeve relative to the outer sleeve effects radial displacement of each paddle blade relative to the outer sleeve to permit a stirring thereof, with the actuator links projecting exteriorly to provide for a handle structure permitting ease of rotation of the stirring device within a container.

4 Claims, 5 Drawing Sheets

STIRRING DEVICE

BACKGROUND OF THE INVENTION

1. Field of the Invention

The field of invention relates to stirring apparatus, and more particularly pertains to a new and improved stirring device wherein the same is arranged for insertion within containers of constricted neck construction permitting access to the contents of the container for stirring thereof.

2. Description of the Prior Art

Stirring of various containers utilizing constricted necks is awkward and difficult, wherein the instant invention provides for a stirring device with radially expanding paddle blades for access to stirring of contents within such container structure. Prior art stirring apparatus is exemplified in the U.S. Pat. No. 4,083,653 to Stiffler setting forth a stirring device wherein the paddle blades are centrifugally projected exteriorly of the elongate central rod during use.

Various other stirring apparatus is exemplified by the U.S. Pat. Nos. 4,184,779; 4,893,940; 4,660,988; and 4,909,634.

Such apparatus has heretofore been of a relatively complex construction not suited for insertion into constricted opening containers as set forth by the instant invention and accordingly, the instant invention attempts to overcome deficiencies of the prior art by providing for a stirring device setting forth ease of use as well as effectiveness in construction in application to constricted opening containers.

SUMMARY OF THE INVENTION

In view of the foregoing disadvantages inherent in the known types of stirring apparatus now present in the prior art, the present invention provides a stirring device wherein the same is arranged with radially expandable paddle blades arranged for stirring of fluid contents within a container. As such, the general purpose of the present invention, which will be described subsequently in greater detail, is to provide a new and improved stirring device which has all the advantages of the prior art stirring apparatus and none of the disadvantages.

To attain this, the present invention provides an elongate inner tubular sleeve slidably mounted within an outer tubular sleeve, with the inner sleeve mounting a plurality of actuator links to permit axial displacement of the inner sleeve relative to the outer sleeve, wherein the inner sleeve pivotally mounts an annular array of paddle blades at a lower distal end of the inner sleeve that are positioned exteriorly of the outer sleeve, whereupon axial displacement of the inner sleeve relative to the outer sleeve effects radial displacement of each paddle blade relative to the outer sleeve to permit a stirring thereof, with the actuator links projecting exteriorly to provide for a handle structure permitting ease of rotation of the stirring device within a container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stirring device which has all the advantages of the prior art stirring apparatus and none of the disadvantages.

It is another object of the present invention to provide a new and improved stirring device which may be easily and efficiently manufactured and marketed.

It is a further object of the present invention to provide a new and improved stirring device which is of a durable and reliable construction.

An even further object of the present invention is to provide a new and improved stirring device which is susceptible of a low cost of manufacture with regard to both materials and labor, and which accordingly is then susceptible of low prices of sale to the consuming public, thereby making such stirring devices economically available to the buying public.

Still yet another object of the present invention is to provide a new and improved stirring device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
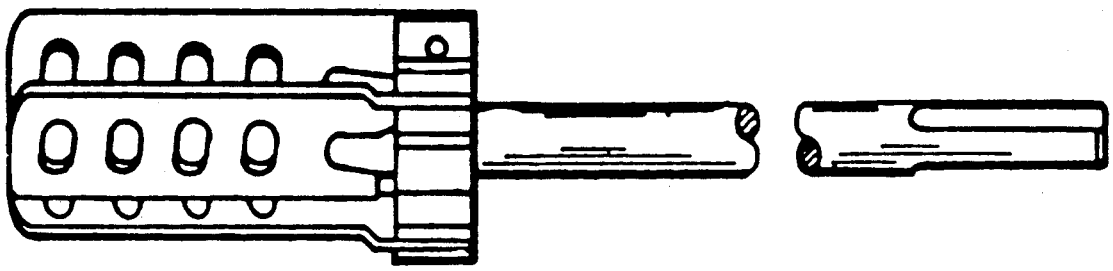
FIG. 1 PRIOR ART
FIG. 1 is an orthographic side view of a prior art stirring device in a first position.

With reference now to the drawings, and in particular to FIGS. 1 to 8 thereof, a new and improved stirring device embodying the principles and concepts of the present invention and generally designated by the reference numeral 10 will be described.

Figure 2:
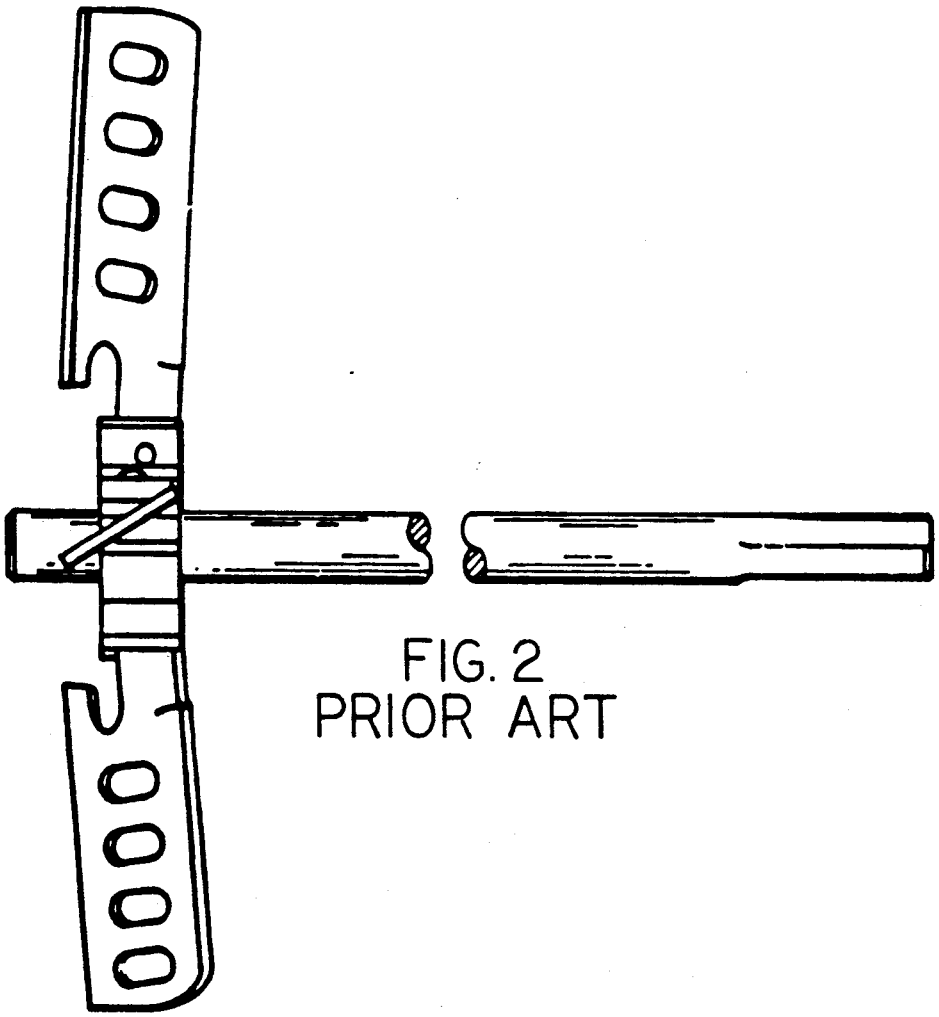
FIG. 2 PRIOR ART
FIG. 2 is an orthographic side view of the stirring device of FIG. 1 in a second expanded position.

The FIGS. 1 and 2 illustrate a prior art stirring device, as exemplified in the U.S. Pat. No. 4,083,653, wherein the paddle blades extend upon centrifugal actuation and rotation of the support rod, in a manner as set forth in the above noted U.S. patent.

More specifically, the stirring device 10 of the instant invention essentially comprises an outer tubular sleeve 11 slidably mounted within an inner tubular sleeve 12. The outer tubular sleeve 11 is defined by a predetermined inner diameter substantially equal to a predetermined outer diameter of the inner tubular sleeve 12 to provide for the inner sleeve to be complementarily received within the outer sleeve in a sliding inter-relationship. The outer sleeve 11 includes an outer sleeve lower distal end 13 spaced from an outer sleeve upper distal end 14. The inner sleeve 12 includes an inner sleeve lower distal end 15 spaced from an inner sleeve upper distal end 16. It should be noted that the inner and outer sleeves 12 and 11 respectively are coaxially aligned along a common axis 26. An inner sleeve first slot 17 is diametrically aligned and coextensive with an inner sleeve second slot 18 that are directed through the inner sleeve adjacent the inner sleeve upper distal end 16. A first U-shaped actuator link 19 is pivotally mounted within the first slot 17 and a second U-shaped actuator link 20 is pivotally mounted within the inner sleeve second slot 18. The first and second actuator links 19 and 20 each include an outer lever arm 21 that extend from an upper distal end of each respective slot relative to a respective first and second pivot axle 22 and 23 of the first and second slots 17 and 18 that are directed downwardly of a length greater than a slot length, with the outer lever arm 21 of each link 19 and 20 pivotally mounted to an abutment nose 24 that is directed downwardly relative to each slot and is positioned interiorly of the inner sleeve 12, wherein the outer lever arms 21 are directed exteriorly of the sleeves 11 and 12, in a manner as typified in FIGS. 3 and 4 for example. In use, the abutment links 19 and 20 are rotated to project the outer lever arms 21 exteriorly relative to the outer sleeve 11 to effect abutment of each abutment nose 24 of each actuator link onto a lower distal end of each of the first and second slots 17 and 18, in a manner as illustrated in FIG. 4, to thereby effect a lifting of the inner sleeves 12 relative to the outer sleeves 11 from a first position, as illustrated in FIG. 3, to a second position, as illustrated in FIG. 4, for each abutment nose 24 to effect abutment with the outer sleeve upper distal end 14.

The inner sleeve lower distal end 15 includes a circular array of mounting flanges 29 projecting exteriorly and outwardly relative to the inner sleeve and projecting beyond the outer sleeve through an associated cylindrical array of outer sleeve first slots 27, wherein each outer sleeve first slot 27 receives a mounting flange 29. Each mounting flange 29 mounts a paddle blade 30 about a paddle blade pivot arm 31. The circular array of mounting flanges 29 are orthogonally oriented relative to the common axis 26, with the outer sleeve first slots arranged parallel relative to the axis 26. A cylindrical array of outer sleeve second slots 28 are provided below the outer sleeve first slots 27. Each outer sleeve first slot 27 is colinear with an outer sleeve second slot 28 positioned below and spaced from each outer sleeve first slot 27. In this manner, each outer sleeve second slot 28 receives the paddle blade 30 in the first position, whereupon lifting of the inner sleeve relative to the outer sleeve to the second position, such as illustrated in the FIG. 4 and FIG. 6, effects abutment of each paddle blade 30 with an abutment surface 32 positioned between the outer sleeve first and second slots 27 and 28, as illustrated in FIG. 6 and in FIG. 5.

Figure 3:
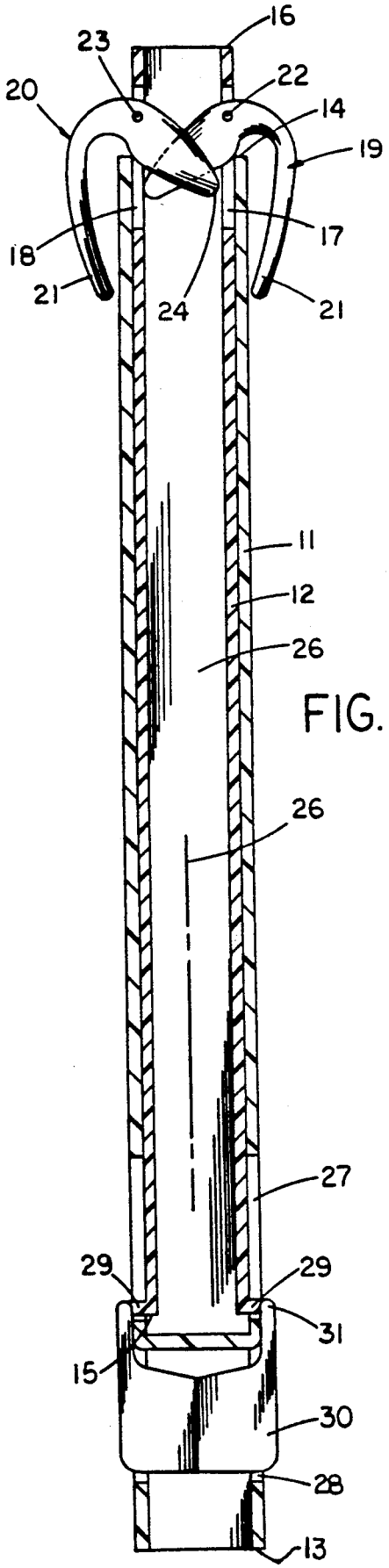
FIG. 3 is an orthographic cross-sectional illustration of the instant invention.
Figure 4:
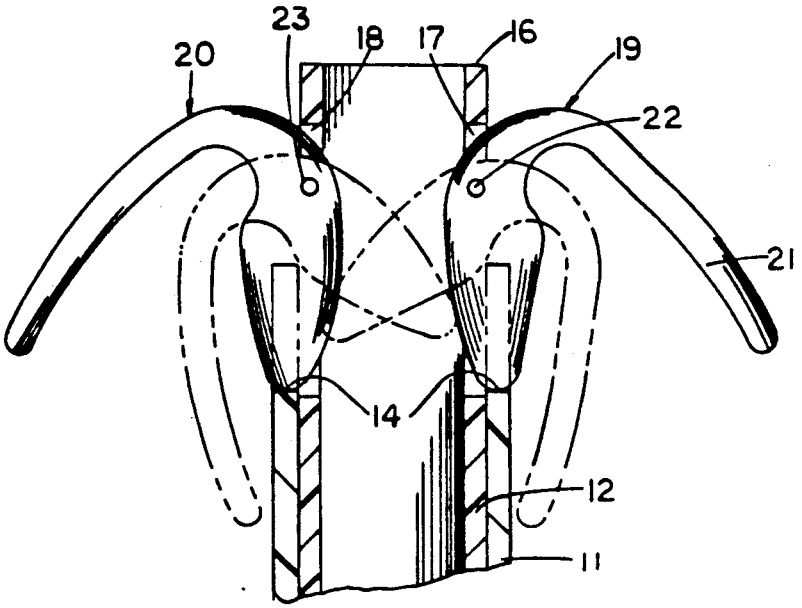
FIG. 4 is a cross-sectional illustration of the invention at an upper portion thereof.
Figure 5:
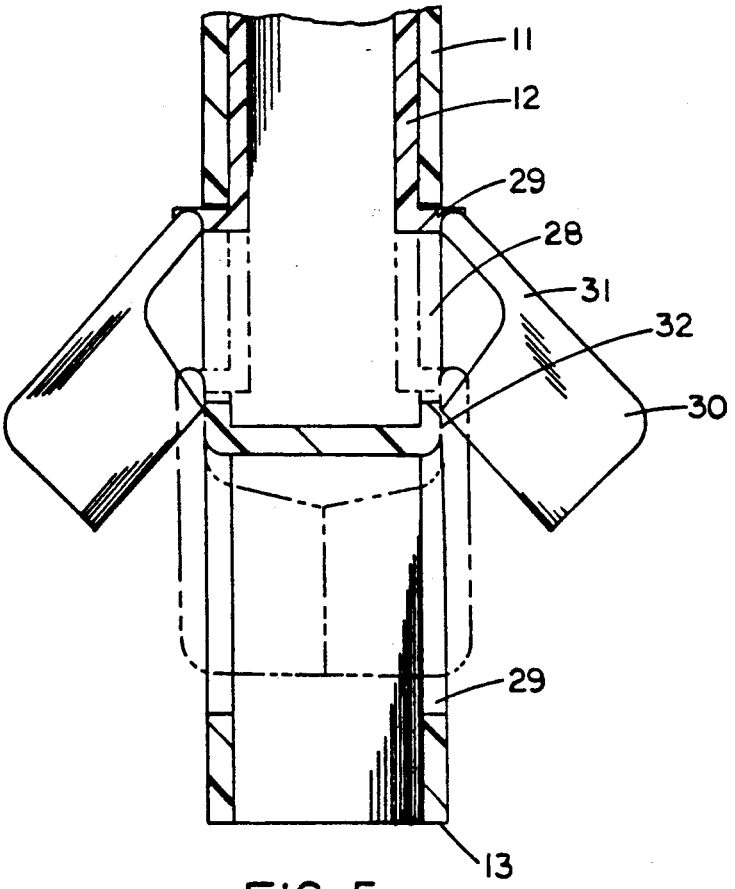
FIG. 5 is an orthographic cross-sectional illustration of the invention at a lower portion thereof.
Figure 6:
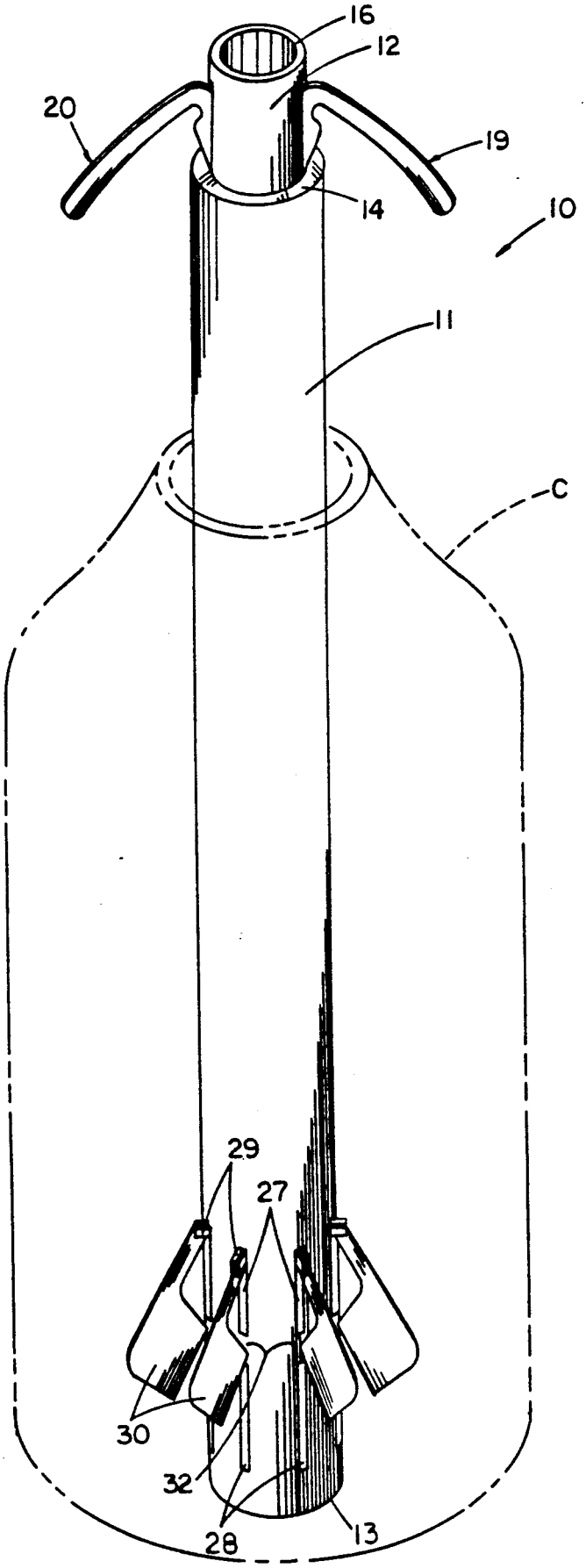
FIG. 6 is an isometric illustration of the invention in application relative to a container.

In this manner, insertion of the stirring device 10 within an associated container "C", such as illustrated in FIG. 6, is available when the device is in the first position, such as illustrated in FIG. 3, whereupon lifting of the actuator links 19 and 20 to the second position, such as illustrated in FIG. 6, projects each of the paddle blades relative to the outer sleeve to permit ease of stirring of contents within the container "C" in use.

Figure 7:
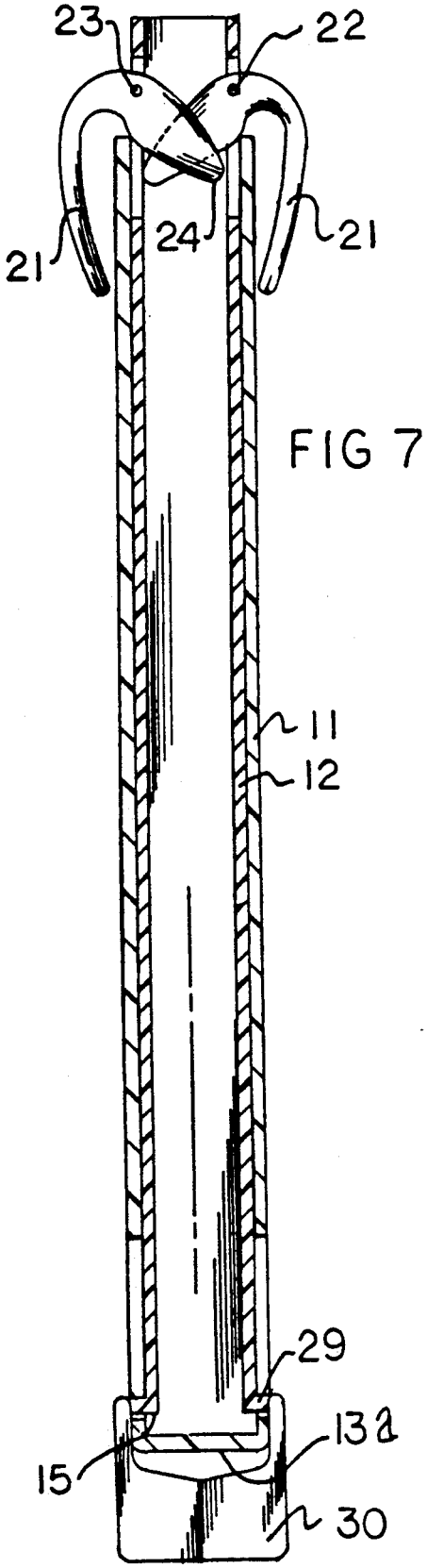
FIG. 7 is an orthographic cross-sectional illustration of a modified structure of the invention, wherein the paddle blades project below the bottom end of the outer sleeve.
Figure 8:
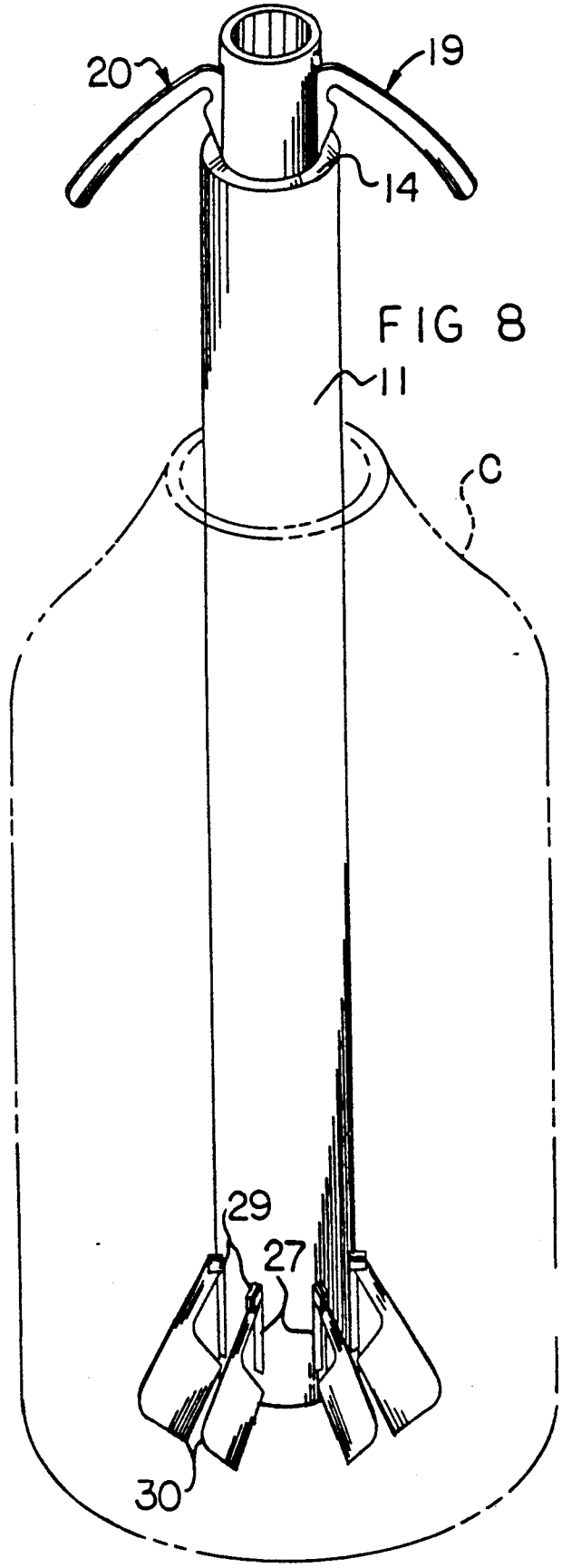
FIG. 8 is an isometric illustration of a modified aspect of the invention in use.

The FIGS. 7 and 8 illustrate the invention wherein the outer sleeve 11 includes a bottom end 13*a* that is positioned above the paddle blades 30 and below their pivot axles 29. This structure is exemplary of a more compact aspect of the invention, while not affording protection to the paddle blades when in use, minimizes the need for alignment of the slots 27 and 28.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stirring device, comprising, an outer tubular sleeve slidably mounted within an inner sleeve, the outer tubular sleeve defined by a predetermined internal diameter, and the inner tubular sleeve defined by a predetermined outer diameter, wherein the predetermined outer diameter is substantially equal to the predetermined internal diameter, and the outer tubular sleeve including an outer sleeve lower distal end spaced from an outer sleeve upper distal end, the inner sleeve including an inner sleeve lower distal end spaced from an inner sleeve upper distal end, and the outer sleeve and the inner sleeve coaxially aligned relative to one another about a common axis, and the inner sleeve including a first actuator link and a second actuator link mounted pivotally to the inner sleeve adjacent the inner sleeve upper distal end, wherein the first actuator link and the second actuator link effect coaxial displacement of the inner sleeve relative to the outer sleeve, and the inner sleeve lower distal end including a plurality of paddle members pivotally mounted to the inner sleeve lower distal end.

2. A device as set forth in claim 1 wherein the inner sleeve lower distal end includes a circular array of mounting flanges extending radially beyond the inner sleeve lower distal end and the outer sleeve, with each mounting flange projecting through the outer sleeve, and each mounting flange pivotally mounting a paddle member thereon.

3. A device as set forth in claim 2 wherein the outer sleeve includes a cylindrical array of outer sleeve first slots spaced above the outer sleeve lower distal end, and a circular array of outer sleeve second slots, each outer sleeve second slot is colinear with an outer sleeve first slot and spaced below one of said outer sleeve first slots and above the outer sleeve lower distal end, and each mounting flange is directed through one of said outer sleeve first slots, and each paddle member is received within one of said outer sleeve second slots in the first position and in abutment with the outer sleeve between one of said outer sleeve first slots and one of said outer sleeve second slots in the second axially displaced position.

4. A device as set forth in claim 3 wherein the inner sleeve includes an inner sleeve first slot diametrically aligned with an inner sleeve second slot adjacent the inner sleeve upper distal end and the first actuator link of a U-shaped configuration and the second actuator link of a U-shaped configuration, with the first actuator link pivotally mounted within the inner sleeve first slot and the second actuator link pivotally received within the inner sleeve second slot, and each actuator link including an abutment nose projecting within the inner sleeve for abutment with the outer sleeve upper distal end in the second position, and each actuator link including an outer lever arm projecting exteriorly of the outer sleeve.

* * * * *